United States Patent [19]

Motohashi

[11] Patent Number: 4,844,441

[45] Date of Patent: Jul. 4, 1989

[54] SHEET CONVEYANCE TABLE FOR SHEET PRESS

[75] Inventor: Chuzabro Motohashi, Ibaraki, Japan

[73] Assignee: Komori Printing Machinery Co., Ltd., Japan

[21] Appl. No.: 933,640

[22] Filed: Nov. 21, 1986

[51] Int. Cl.[4] ..... B65H 9/00

[52] U.S. Cl. ..... 271/240; 271/253

[58] Field of Search ..... 271/238, 239, 240, 248, 271/250, 253; 248/125; 198/600

[56] References Cited

U.S. PATENT DOCUMENTS

| | | | |
|---|---|---|---|
| 2,726,864 | 12/1955 | Weechter | 271/248 |
| 3,709,484 | 1/1973 | Kistner | 271/251 |
| 4,657,239 | 4/1987 | Ikesue et al. | 271/240 |

*Primary Examiner*—Joseph J. Rolla
*Assistant Examiner*—David H. Bollinger
*Attorney, Agent, or Firm*—James R. Ignatowski; Remy J. VanOphem

[57] ABSTRACT

A sheet conveyance table for a sheet rotary press disposed in a gap between a plurality of conveyance tapes conveying a sheet fed from a sheet feeder and a feed board. The sheet conveyance table is constituted by stays suspended in the gap perpendicular to the sheet conveyance direction; a pair of support tables, supported at two end portions of the stays, and a plurality of sheet receiving members. The pair of support tables are movable in a widthwise direction of the rotary press to adjust for sheets received from the conveyance tapes having different widths. The support tables also support side registering devices which align one side of the sheet as it passes over the sheet conveyance table. The sheet receiving members are formed by a thin plate material having a substantially U-shape when viewed from the top and are arranged along the stays so that their widths are increased when the support tables are displaced away from each other and reduced upon movement of the support tables towards each other.

5 Claims, 2 Drawing Sheets

SHEET CONVEYANCE TABLE FOR SHEET PRESS

BACKGROUND OF THE INVENTION

1. Field of the Invention

The present invention relates to a sheet feed table for feeding a sheet fed onto a feeder board by sheet feed rollers of a sheet feeder of a sheet press while registering the sheet in a lateral direction or a direction perpendicular to a sheet conveyance direction between the feeder board and a feed board.

2. Description of the Prior Art

A plurality of conveyance tapes, extended on a feeder board, for conveying a sheet, a feed board for slidably feeding the conveyed sheet, a registering device, arranged at the distal end portion of the feed board, for registering a sheet in the sheet conveyance direction, and a swing device for feeding the registered sheet to printing units are arranged between a sheet feeder and the printing units of a sheet rotary press. The feeder board and the feed board are coupled through a conveyance table, a so-called "ditch board", and side lay devices for registering the sheet in the lateral direction are arranged at two sides of the conveyance table.

When a sheet size is changed, the total width of the conveyance table must be increased or reduced accordingly and the positions of the side lay devices must be adjusted. Conventionally, the conveyance table is divided into several sections in the widthwise direction of the sheet, so that a central one is fixed and several ones at two sides thereof are detachably mounted. Each time the sheet size is changed, a required number of sections of the conveyance table are mounted or removed and the positions of the side lay devices are adjusted in accordance with the sheet size.

However, in the conventional detachable structure of the conveyance table, a plurality of pairs of front and rear leaf springs are arranged on the back side of conveyance boards to be perpendicular thereto, and a stay, extending below the conveyance boards, for supporting the side lay devices is clamped by these leaf springs in the back-and-forth directions. Therefore, this structure poses various problems.

More specifically, if the biasing force of these leaf springs is weak, the leaf springs rattle during the operation of the press, resulting in noisy operation. In addition, print trouble often occurs due to vibration. If the biasing force of the leaf springs is strengthened in order to prevent this, it becomes difficult to remove the conveyance boards. If the conveyance boards are forcibly removed, the leaf springs may be damaged. Upon repetitive mounting/removing operations, the biasing force of the springs is attenuated.

The present applicant has proposed a sheet conveyance table which is free from the above drawbacks, as described in Japanese Utility Model Prepublication No. 57-155375. This conveyance table will be described below with reference to FIGS. 4 and 5. FIG. 4 is a schematic side view partially showing a multicolor sheet rotary press which includes this sheet conveyance table, and FIG. 5 is a perspective view of the sheet conveyance table. The rotary press is composed of a sheet feeder 1 and a plurality of printing units 2 (only one unit is shown). The sheet feeder 1 includes a sheet stacker 4 which stacks sheets 3 thereon and moves upward as the number of sheets 3 decreases upon sheet feeding, and a sucker device (not shown) for drawing the sheets 3 by suction one by one from the uppermost sheet to feed them between a pair of sheet feed rollers 5 and 6. Each printing unit 2 has a plate cylinder 7 on the peripheral surface of which a print plate is mounted, a rubber blanket cylinder 8 to which an image formed on the plate surface is transferred, and an impression cylinder 9 for applying a printing pressure to the sheet 3 passing between itself and the rubber blanket cylinder 8. A transfer cylinder 10 for transferring the sheet 3 is arranged between the impression cylinders 9 of adjacent printing units 2.

A feeder board 11 is arranged between the sheet feed rollers 5 and 6 and the front edge portion of the printing unit 2 to be slightly inclined. The feeder board 11 is formed of a wood plate and has a width slightly larger than the maximum width of a sheet. A pair of rollers 12 and 13 are axially and rotatably supported near the front and rear edge portions of the feeder board 11. A plurality of conveyance tapes 14 are arranged between the rollers 12 and 13 to be parallel to each other in the widthwise direction of the feeder board 11, and their upper traveling portions are in contact with the feeder board 11. Reference numeral 15 denotes a small frame for supporting the rollers 12 and 13 and the feeder board 11. The small frame 15 is rotatably fixed to the frame of the sheet feeder 1 by a bracket (not shown) and is capable of moving upward with the roller 12 as the rotatable edge. The rotatable edge side member is supported by a hook-shaped member provided on the frame side of the printing unit 2. In front of the small frame 15, a feed board 16 having substantially the same width as that of the feeder board 11 is arranged between the frames of the printing unit 2 to form a predetermined gap between itself and the front edge of the small frame 15 and to be inclined through substantially the same angle as that of the feeder board 11. A registering device having a front lay 17 or the like is arranged on the front edge portion of the feed board 16. Reference numeral 18 denotes a swing device which grips and swings the sheet 3 which abuts against the front lay 17 and is stopped, to cause the grippers of the impression cylinder 9 to alternately grip the sheet 3. Although not shown, a sheet urging roller for urging the sheet 3 against the conveyance tapes 14 is arranged above the feeder board 11.

A stay 19 is supported between the small frame 15 and the feed board 16, such that its two ends are fixed to right and left frames 20 of the printing unit 2. Known side lay devices 21 for registering the conveyed sheet 3 in the lateral direction are mounted on the two end portions of the stay 19 to be movable in the widthwise direction of the press for adjustment. A central conveyance board 23 constituting a conveyance table together with the stay 19 and a plurality of conveyance boards 24 are arranged on the stay 19 to be parallel to each other in the widthwise direction of the sheet 3. The central conveyance board 23 has a width slightly larger than a prospective minimum width of a sheet, and is fixed to the stay 19 by screws. The number of the conveyance boards 24 is selected in accordance with the size of the sheet 3, and they are mounted on or removed from the stay 19. Although not shown, the conveyance boards 24 are mounted on the stay 19 to be attracted by rubber magnets buried in the stay 19 so as not to be movable. When metal members arranged on the back surfaces of the conveyance boards 24 abut against the stay 19 and the front edges of the conveyance boards 24 are engaged with the stepped portion of the feed board 16, their movement in the back-and-forth direction is restricted.

With the above arrangement, the sheets 3 stacked on the sheet stacker 4 are drawn by suction one by one by the sucker device and are fed forward. The sheet 3 is then caught by the vertically aligned sheet feed rollers 5 and 6 to be fed onto the conveyance tapes 14, and is conveyed thereby. The conveyed sheet 3 is released from the conveyance tapes 14 at the position of the roller 12, and is fed onto the conveyance boards 23 and 24. Then the sheet 3 slides along the conveyance boards 23 and 24, and along the feed board 16 until it abuts against the front lay 17 to be registered in the sheet conveyance direction. Then the sheet 3, which is at a stand still with one edge thereof held in contact with the front lay 17, is pulled laterally to be registered in the lateral direction. Then the sheet 3 is gripped by the swing device 18, and is then gripped by the grippers of the impression cylinder 9 to be subjected to printing while being conveyed.

Assuming that the sheet size is changed from the maximum size to one having a smaller width, the conveyance boards 24 is removed from each end, and the side lay devices 21 are moved a predetermined distance toward the center. In this manner, as the size of the sheet 3 is reduced, the outside conveyance boards 24 are removed one by one, and only the fixed conveyance board 23 is used for a minimum sized sheet.

In the conventional sheet conveyance table, since the conveyance boards 24 are attached by the rubber magnets, no noise is generated and they can be easily mounted or removed. However, since the conveyance boards 24 must be removed or added each time the sheet size is changed, this results in a cumbersome operation and takes much labor and time. In addition, since a portion under the conveyed sheet 3 is entirely shielded by the conveyance boards 23 and 24, an airflow interposed between the sheet 3 and the conveyance boards 23 and 24 cannot escape, so that the sheet 3 swells, resulting in misregistration.

SUMMARY OF THE INVENTION

It is, therefore a principal object of the present invention to provide a sheet conveyance table for a sheet rotary press which can be easily adjusted in position in accordance with a change in sheet size, and can improve its operability.

It is another object of the present invention to provide a sheet conveyance table for a sheet rotary press which can satisfactorily keep print registration.

It is still another object of the present invention to provide a sheet conveyance table for a sheet rotary press which can be operated noiselessly and improve its operation environment.

In order to achieve the above objects, there is provided a sheet conveyance table for a sheet rotary press disposed in a gap portion between a plurality of conveyance tapes for conveying a sheet fed from a sheet feeder and a feed board at a downstream side in a sheet conveyance direction, including stays suspended in the gap portion to be perpendicular to the sheet conveyance direction; a pair of support tables, supported at two end portions of the stays to be movable in the widthwise direction of the rotary press for adjustment, for supporting sheet side registering devices; and a plurality of sheet receiving members, which are formed of a thin plate material having an elasticity to have a substantially U-shape when viewed from the top and which are arranged along the stays so that their widths are increased or reduced upon movement of the support tables.

With this arrangement, a sheet conveyed by conveyance tapes is fed onto a feed board via parallel sheet receiving members, and is registered in the lateral direction by side registering devices when it passes by the sheet receiving members. When the size of a sheet is changed from a large width to a small width, the side registering devices are moved inwardly together with their support tables to be adjusted to the selected sheet width. Thus, the plurality of sheet receiving members clamped by the support tables are contracted against their elasticity to obtain the sheet size having the small width. When the size of a sheet is changed from a small width to a large width, the support tables are moved outwardly to be adjusted to the sheet width. Thus, the sheet receiving members are extended due to their elasticity to correspond to the sheet size having the large width. Since each sheet receiving member has a hollow U-shape, even if an airflow enters between itself and the sheet conveyed thereon, the airflow escapes downward through the sheet receiving member and will not remain there.

BRIEF DESCRIPTION OF THE DRAWINGS

FIGS. 1 to 3 show a sheet conveyance table for a sheet rotary press according to an embodiment of the present invention, in which FIG. 1 is a plan view of an end portion thereof, FIG. 2 is a perspective view of a sheet receiving member, and FIG. 3 is a plan view showing a state wherein the sheet receiving members are contracted in correspondence with FIG. 1;

DETAILED DESCRIPTION OF THE PREFERRED EMBODIMENT

An embodiment of the present invention will now be described with reference to the accompanying drawings.

Figure 1:
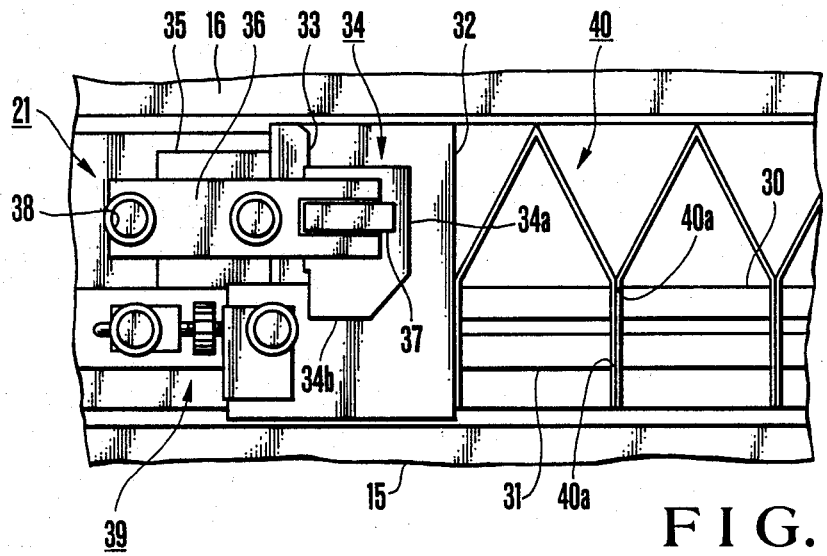
Figure 2:
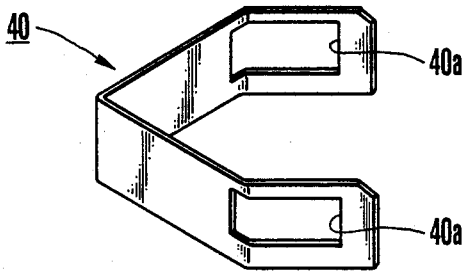
Figure 3:
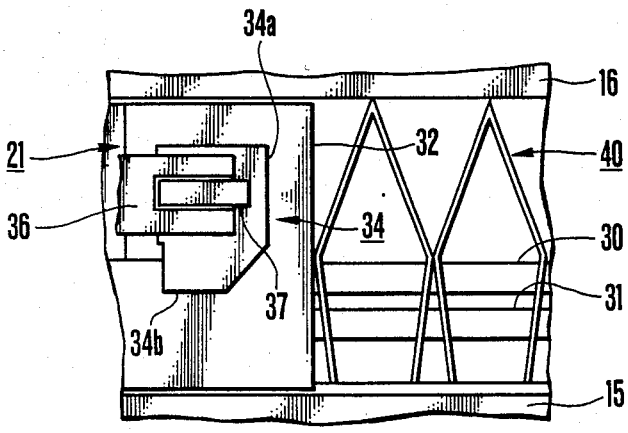
Figure 4:
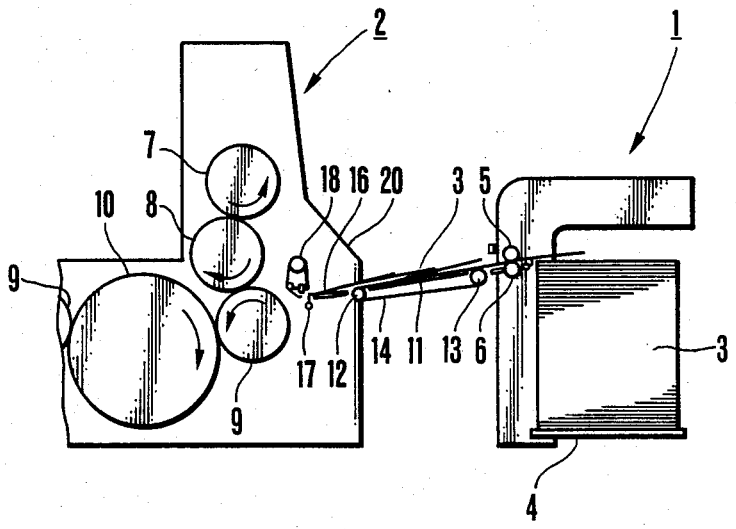
FIG.4 PRIOR ART
FIG. 4 is a schematic side view partially showing a multicolor sheet rotary press for explaining a position of a sheet conveyance table.
Figure 5:
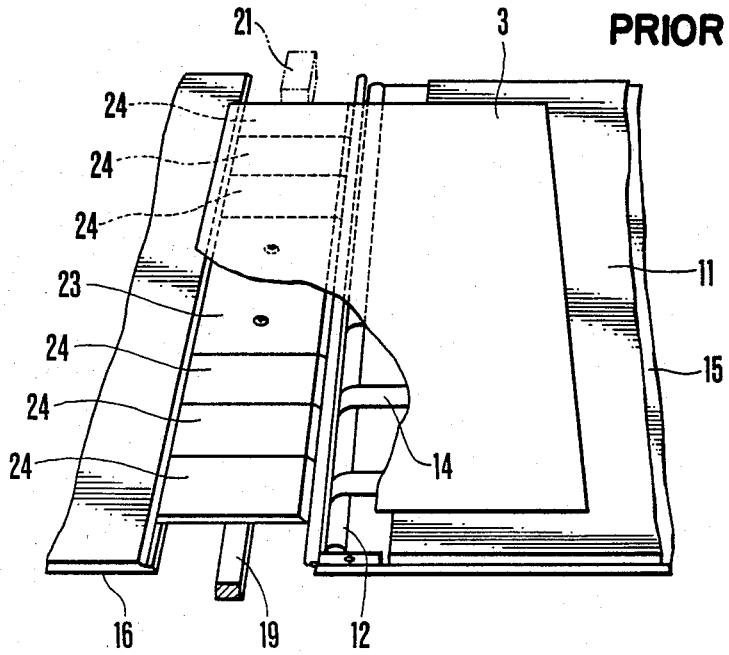
FIG.5 PRIOR ART
FIG. 5 is a perspective view of a conventional sheet conveyance table of a sheet rotary press.

Since the arrangement of the entire rotary press in FIGS. 1 to 3 is the same as the conventional rotary press shown in FIGS. 4 and 5 except for a sheet conveyance table, a detailed description thereof is omitted, and it will be briefly described hereinafter with reference to FIGS. 4 and 5. A small frame 15 is suspended between a sheet feeder 1 and printing units 2. A feeder board 11 and a plurality of conveyance tapes 14 parallel to each other in the widthwise direction of the rotary press are arranged on the frame 15. After sheet feeding, a sheet 3 fed onto the feeder board 11 through upper and lower sheet feed rollers 5 and 6 is conveyed by the conveyances tapes 14, and is then fed onto a feed board 16 arranged to have a gap between itself and the conveyance tapes 14.

In the gap between the conveyance tapes 14 and the feed board 16, a pair of front and rear stays 30 and 31 having a rectangular cross-section are suspended between right and left frames 20 to be perpendicular to the conveyance direction of the sheet 3. A pair of right and left support tables 32 are arranged in the two end portions of the gap in the widthwise direction of the rotary press, and supported by the stays 30 and 31 to be movable for adjustment. Side lay devices 21, as side registering devices having the same arrangement as the conventional ones shown in FIG. 5, are symmetrically arranged and fixed on the support tables 32. The right and left side lay devices 21 are not used at the same time. The left side lay device 21 viewed along the sheet feed direction is used for normal surface printing, and the opposite device 21 is used when a sheet after surface printing is reversed and is subjected to back printing. The arrangement and operation of the side lay devices will be described below in more detail. An elongated columnar lay 33 and an urging plate 34 whose two edge portions 34*a* and 34*b* are inclined upward at the entrance side of the sheet 3 are fixed on the support table 32. A roller arm 36 is fixed by screws to a cam lever 35 swingably supported to the side of the support 32. An urging roller 37 is pivotally supported at the swing end side of the roller arm 36 to be engaged in a rectangular hole formed in the urging plate 34. A sheet receiving roller (not shown) is arranged below the urging roller 37 to be in surface contact therewith. The roller arm 36 and the cam lever 35 are engaged with a cam and a spring member (neither is shown), so that the urging roller 37 is vertically moved to be urged against or separated from the sheet receiving roller at a predetermined cycle, and the sheet receiving roller is reciprocally pivoted in the normal and reverse directions through a predetermined angle at the same cycle as the vertical movement of the urging roller 37. Reference numeral 38 denotes a screw member for adjusting the urging force of the urging roller 37; and 39 denotes an adjusting mechanism for finely adjusting the position of the entire side lay device 21 in the horizontal direction. With this arrangement, when the sheet edge portion of the conveyed sheet 3 enters the urging plate 34 from the side of the edge 34*b*, the sheet receiving roller is pivoted clockwise when the urging roller 37 is at its upper position. In this case, when the urging roller 37 is at its lower position, the sheet receiving roller is pivoted counterclockwise. As a result, the sheet edge is clamped between the urging roller 37 and the sheet receiving roller to be urged against the columnar lay 33, so that the sheet edge is aligned and the sheet is registered in the lateral direction. When the width of the sheet 3 is reduced, the two side lay devices 21 are moved toward the center of the press together with their support tables 32. Otherwise, they are moved outwardly.

A plurality of sheet receiving members 40 are arranged between the support tables 32 for supporting the right and left side lay devices 21 with the above arrangement. Each sheet receiving member 40 is formed of a thin steel plate or a synthetic resin plate having an elasticity to have a substantially U-shape when viewed from the top. Rectangular holes 40*a* are formed to two leg portions of the sheet receiving member 40 aligned in the widthwise direction of the press. The stays 30 and 31 are fitted in the holes 40*a* to be arranged in tight contact with each other. When the support tables 32 are extended outwardly to the maximum extent in correspondence with the maximum size of a sheet, the sheet receiving members 40 are in tight contact with each other to leave a small elasticity therein. As the size of the sheet 3 is reduced and the support tables 32 are moved toward the center, the sheet receiving members 40 are elastically deformed accordingly, as shown in FIG. 3, so that they are in tight contact with each other while their widths are being reduced.

With the above arrangement, the sheets 3 stacked on the sheet stacker 4 are drawn by suction one by one by the sucker device to be fed forward. The fed sheet 3 is caught by the upper and lower sheet feed rollers 5 and 6 to be fed onto the conveyance tapes 14. Thereafter, the sheet 3 is conveyed by the tapes 14. The conveyed sheet 3 is released from the conveyance tapes 14 at the position of the roller 12 and is fed onto the sheet receiving members 40 to slide thereon. In this case, the edge portion of the sheet 3 enters the urging plate 34 of the side lay device 21 from the edge 34*b* and vertical movement of the urging roller 37 and reciprocal pivotal movement of the sheet receiving roller are repeated with respect to the sheet edge at the same cycle. In other words, after the sheet 3, which slides along the conveyance boards 23 and 24 and along the feed board 16, abuts against the front lay 17 to be registered in the sheet conveyance direction and is stopped in position, it is pulled by the above-mentioned rollers of the side lay device 21 to be registered in the lateral direction. Thereafter, the sheet 3 is gripped by the swing device 18, and is then gripped by the grippers of the impression cylinder 9 to be subjected to printing while being conveyed.

An airflow often enters below the sheet 3 conveyed to be slid along the sheet receiving members 40. However, since each sheet receiving member 40 and a V-shaped portion between adjacent sheet receiving members 40 are entirely open to the upper and lower spaces, the airflow entering below the sheet 3 escapes downward and will not remain therebelow to swell the sheet 3.

When the specification of a sheet to be printed is changed from the maximum width to a smaller width, the support tables 32 are moved toward the center of the press to be roughly adjusted to the sheet width and, thereafter, the position of the columnar lay 33 of the side lay device 21 is finely adjusted. When the support tables 32 are moved to adjust the positions of the side lay devices 21, the sheet receiving members 40 are elastically deformed while being slid along the stays 30 and 31, as shown in FIG. 3, thus reducing their widths. If the width of the sheet receiving member 40 is reduced, its height is not changed so as not to impair a function for allowing the sheet 3 to slide thereon. If the specification of the sheet 3 is altered from a small width to a large width, when the support tables 32 are moved outwardly to position the side lay devices 21, the widths of all the sheet receiving members 40 are widened accordingly and they maintain a contact state by means of their elasticity.

Since the sheet receiving members 40 are extended or contracted upon movement of the side lay devices 21, the conveyance boards 24 and the like need not be mounted or removed each time the sheet width is changed, unlike the conventional table. In addition, since the total width of the sheet receiving members 40 can be adjusted finely, the side lay devices 21 can be easily positioned. The sheet receiving members 40 are always in tight contact with each other, resulting in a noiseless operation.

In the above embodiment, the case has been exemplified wherein the two side lay devices are moved with reference to the center of the sheet width when the sheet width is changed. However, a sheet width may be changed with reference to one side of the sheet in accordance with the types of press. In this case, only an unused side lay device can be moved.

As is apparent from the above description of the present invention, in a sheet conveyance table for a sheet rotary press, the sheet conveyance table disposed in a gap portion between sheet conveyance tapes and a feed board includes stays extending along the widthwise direction of the press in the gap portion, a pair of side registering support tables supported at two end portions of the stays to be movably adjusted in the widthwise direction of the press, and a plurality of sheet receiving members which are formed of a thin plate having an elasticity to have a substantially U-shape when viewed from the top and are extended or contracted upon movement of the support tables. The space for aligning the sheet receiving members communicates with the upper and lower spaces. Thus, even if an airflow enters below a conveyed sheet, since this airflow escapes downward and does not swell the conveyed sheet, printing registration can be satisfactorily maintained. Since the sheet receiving members are in tight contact with each other, a noiseless operation is allowed, thus improving an operating environment. Since the sheet receiving members need not be mounted or removed each time the size of a printing sheet is changed, this can reduce labor and shorten a printing preparation time. Furthermore, since the total width of the sheet receiving members can be adjusted finely, the side lay devices can be easily positioned, improving operability.

What is claimed is:

1. A sheet conveyance table for a sheet rotary press disposed in a gap portion between a plurality of conveyance tapes for conveying a sheet fed from a sheet feeder and a feed board at a downstream side in a sheet conveyance direction, said sheet conveyance table comprising stays suspended in the gap portion perpendicular to the sheet conveyance direction; a pair of support tables, supported at two end portions of said stays for supporting sheet side registering devices, said support tables being movable in the widthwise direction of said rotary press for adjustment, and a plurality of elastic sheet receiving members arranged along said stays so that their widths are increased upon the displacement of said support tables along said stays away from each other and reduced upon the displacement of said support tables along said stays towards each other; each of said elastic sheet receiving members being formed of a thin plate elastic material having an elasticity, said thin plate elastic material having a pair of legs connected to each other at one end by a connecting portion, said elastic sheet receiving members having a substantially U-shape when viewed from the top, each of said elastic sheet receiving members further having means for inhibiting displacement in a direction perpendicular to a plane formed by said stays and said sheet conveyance direction, said means for inhibiting further defining a rectangular hole in each of said pair of legs, said stays passing through said rectangular hole in each of said pair of legs thereby inhibiting said displacement in a direction perpendicular to said plane.

2. A sheet conveyance table according to claim 1, wherein the areas between adjacent elastic sheet receiving members are entirely open to the gap portion in a direction normal to a plane defined by said sheet conveyance direction and said stays.

3. A sheet conveyance table according to claim 2, wherein said adjacent elastic sheet receiving members are always in elastic contact with each other.

4. A sheet conveyance table according to claim 3, wherein said registering devices change the width of said sheet conveyance table with reference to the center of the sheet width.

5. A sheet conveyance table according to claim 3, wherein said registering devices change the width of said sheet conveyance table with reference to one side of a sheet.

* * * * *

UNITED STATES PATENT AND TRADEMARK OFFICE

CERTIFICATE OF CORRECTION

PATENT NO. : 4,844,441

DATED : July 4, 1989

INVENTOR(S) : Chuzabro Motohashi

It is certified that error appears in the above-identified patent and that said Letters Patent is hereby corrected as shown below:

Column 3, line 22, after "width," insert ---- one of ----.

Column 5, line 15, after "support" insert ---- table ----.

Column 5, line 53, delete "to" and insert ---- in ----.

Column 7, line 21, delete "a".

Signed and Sealed this

Eighth Day of January, 1991

*Attest:*

*Attesting Officer*

HARRY F. MANBECK, JR.

*Commissioner of Patents and Trademarks*